US008248188B2

(12) United States Patent
Wong

(10) Patent No.: US 8,248,188 B2
(45) Date of Patent: Aug. 21, 2012

(54) FIXATION ARRANGEMENT FOR RESONATOR OF CAVITY FILTER

(75) Inventor: Kwo-Jyr Wong, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 322 days.

(21) Appl. No.: 12/697,341

(22) Filed: Feb. 1, 2010

(65) Prior Publication Data

US 2010/0271153 A1 Oct. 28, 2010

(30) Foreign Application Priority Data

Apr. 23, 2009 (CN) ..... 2009 2 0302517 U

(51) Int. Cl.
*H01P 1/20* (2006.01)
*H01P 7/04* (2006.01)

(52) U.S. Cl. ..... 333/203; 333/223; 333/231

(58) Field of Classification Search ..... 333/202, 333/206, 207, 222–224, 235, 231, 203; 411/541, 411/542, 371.1
See application file for complete search history.

(56) References Cited

U.S. PATENT DOCUMENTS

| | | | | |
|---|---|---|---|---|
| 5,136,270 | A * | 8/1992 | Hatanaka et al. | 333/219.1 |
| 6,323,746 | B1 * | 11/2001 | Prager et al. | 333/219.1 |
| 6,452,466 | B1 * | 9/2002 | Henningsson et al. | 333/222 |
| 6,535,086 | B1 * | 3/2003 | Liang et al. | 333/219.1 |
| 7,400,221 | B2 * | 7/2008 | Kubo et al. | 333/206 |
| 2006/0239797 | A1 * | 10/2006 | Evanbar | 411/542 |

* cited by examiner

*Primary Examiner* — Seungsook Ham
(74) *Attorney, Agent, or Firm* — Altis Law Group, Inc.

(57) ABSTRACT

A fixation arrangement for a resonator of a cavity body includes a cavity body including a base, a resonator defining a cavity and comprising a bottom, a screw including sharply arc-shaped head and securing the resonator on the base of the cavity body, and a sticky element located between the screw head of the screw and the bottom of the resonator.

7 Claims, 2 Drawing Sheets

FIXATION ARRANGEMENT FOR RESONATOR OF CAVITY FILTER

BACKGROUND

1. Technical Field

The disclosure relates to cavity filters, and more particularly relates to a resonator of a cavity filter.

2. Description of Related Art

Cavity filters are popularly applied in mobile communications. FIG. 2 is a cross-sectional view of a commonly used cavity filter 100. The cavity filter 100 comprises a cavity body 110 defining an opening in a top portion thereof and comprising a plurality of bases 1101 on the bottom portion thereof, a plurality of resonators 10 attached to the bases 1011 by screws 140, and a lid 120 to cover the opening of the cavity body 110. Each resonator 10 defines a cavity 101 in communication with the cavity body 110, and a bottom 102 secured on one of the bases 1101 by one of the screws 140. The lid 120 defines a plurality of screw holes 121 each matched with a tuning screw 130 and opposite to the cavity 101 of one of the resonators 10. The tuning screws 130 are used to adjust a resonating frequency of the cavity filter 100.

However, when adjusting the frequency of the cavity filter 100, metal shavings may be produced by the tuning screw 130, which are prone to adhere on the bottoms 102 and the heads of the screws 140, because the tuning screws 130 and the lid 120 are both made of metal materials. When the cavity filter 100 is carried from one place to another place, the metal shavings may scatter onto some sensitivity electric field areas of the cavity body 110, which results in intermodulation distortion (IMD) of the cavity filter 100.

Therefore, a need exists in the industry to overcome the described limitations.

DETAILED DESCRIPTION

Figure 1:
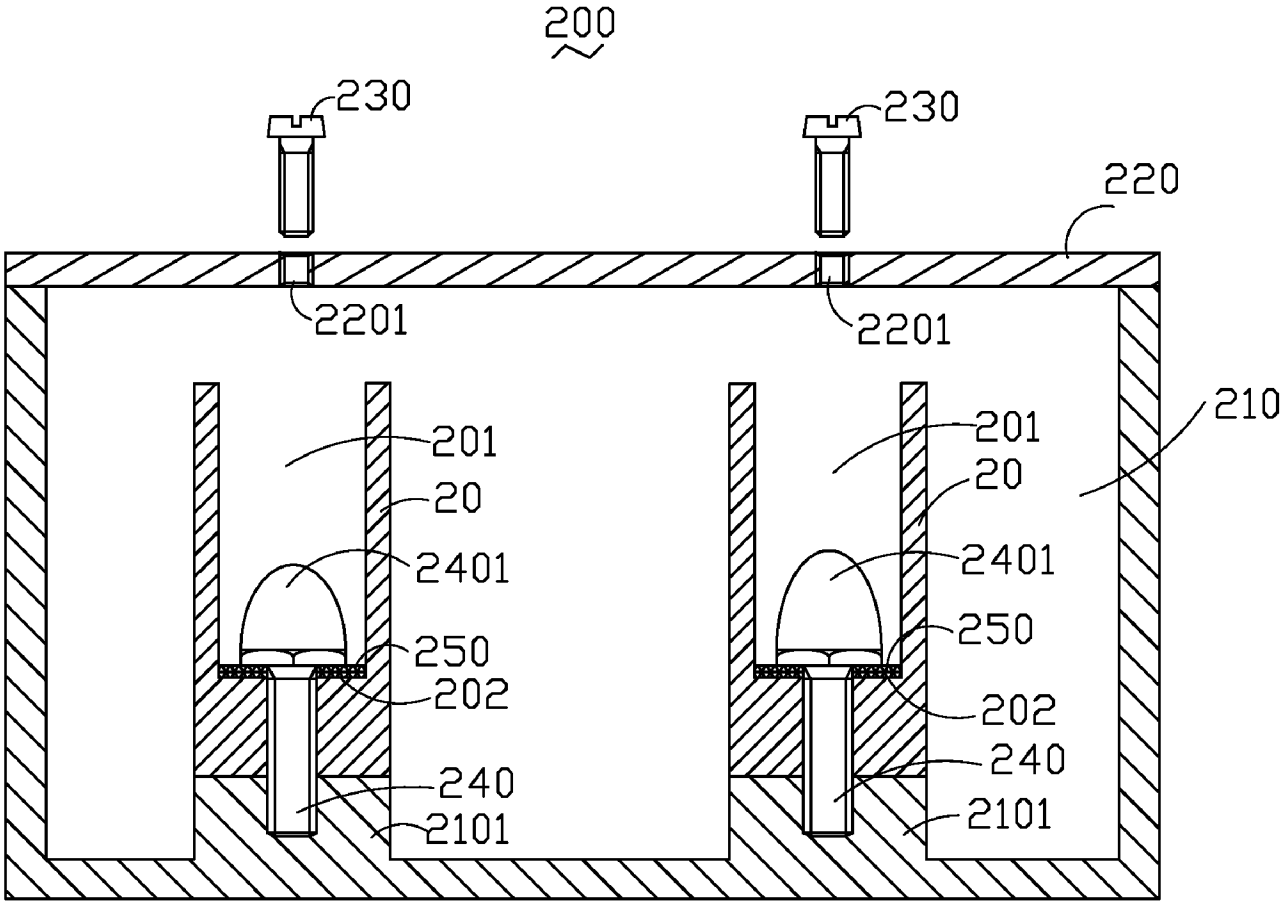
FIG. 1 is a cross-sectional view of a cavity filter in accordance with an exemplary embodiment of the disclosure.
Figure 2:
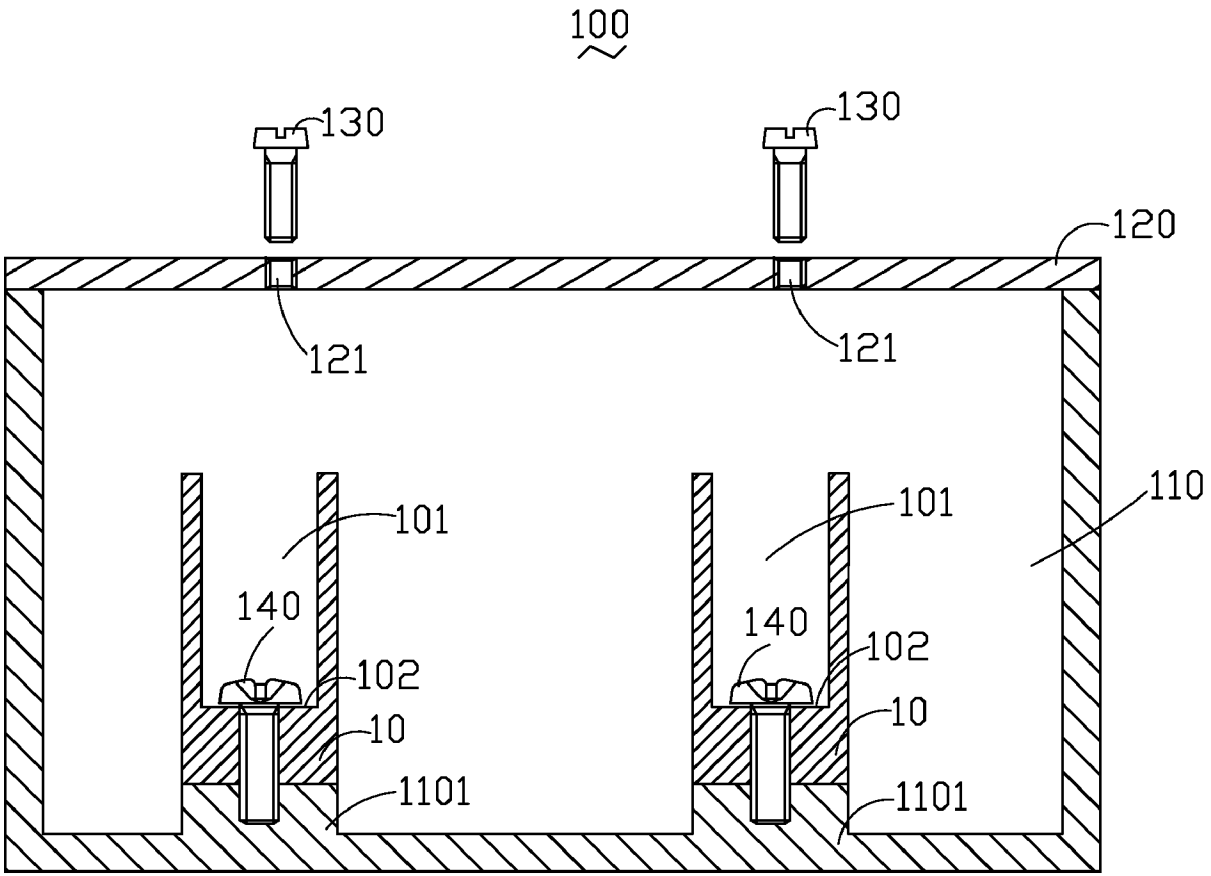
FIG.2 (RELATED ART)
FIG. 2 is a cross-sectional view of a commonly used cavity filter.

FIG. 1 is a cross-sectional view of a filter cavity 200 in accordance with an exemplary embodiment of the disclosure. The filter cavity 200 comprises a cavity body 210, a plurality of resonators 20, a plurality of screws 240, a plurality of sticky elements 250, and a lid 220. In the embodiment, only two resonators 20 are shown for simplification and convenience of description, accordingly, there are two screws 240 and two sticky elements 250; however, it may be understood that more than two resonators, screws, and sticky elements may be used without departing from the spirit of the disclosure.

The cavity body 210 defines an opening in a top portion thereof, and comprises a plurality of bases 2101 on a bottom portion thereof. In the embodiment, the bases 2101 are integrated with the cavity body 210. The resonators 20 are secured on the bases 2101 with the screws 240. The lid 220 covers the opening of the cavity body 210, and defines a plurality of screw holes 2201 corresponding to the plurality of resonators 20. Each of the screw holes 2201 is matched with a tuning screw 230. The tuning screws 230 are screwable in the screws holes 2201 to adjust a resonating frequency of the cavity filter 200.

Each of the plurality of resonators 20 defines a cavity 201 in communication with the cavity body 210 and opposite to one of the screw holes 2201 in the lid 220, and comprises a bottom 202 secured on one of the bases 2101 of the cavity body 210 by one of the screws 240. Each of the sticky elements 250 is located between the bottom 202 of one of the resonators 20 and a screw head 2401. The sticky elements 250 are positioned to catch metal shavings produced when the tuning screws 230 are turned in the lid 220 when the resonating frequency of the cavity filter 200 is adjusted.

In the embodiment, the screw head 2401 of each of the screws 240 is sharply arc-shaped. When the resonating frequency of the cavity filter 200 is adjusted, metal shavings produced by the tuning screws 230 slide along the arc-shaped screw heads 2401 of the screws 240 and are adhered to the sticky elements 250. Whenever the cavity filter 200 is carried from one place to another place, the metal shavings will not be scattered onto the cavity body 210 of the cavity filter 200 because they are stuck to the sticky element 250. Because the bottoms 202 of the plurality of the resonators 20 are weak electric field areas of the cavity filter 200, the metal shavings that collect on the bottoms of the plurality of resonators 20 will not influence performance of the cavity filter 200, which leads to improvement of intermodulation distortion (IMD) of the cavity filter 200 and strengthens the stability of the cavity filter 200.

In one embodiment, the sticky elements 250 may be double sided adhesive tapes.

While the exemplary embodiment has been described, it should be understood that it has been presented by way of example only and not by way of limitation. The breadth and scope of the disclosure should not be limited by the described exemplary embodiments, but only in accordance with the following claims and their equivalent.

What is claimed is:

1. A fixation arrangement for a resonator of a cavity body, comprising:

a cavity body comprising a base;

a resonator defining a cavity and comprising a bottom;

a screw comprising a sharply arc-shaped head to secure the bottom of the resonator on the base of the cavity body; and a sticky element located between the head of the screw and the bottom of the resonator;

wherein metal shavings slide along the sharply arc-shaped head of the screw and are adhered to the sticky element.

2. The fixation arrangement for a resonator of a cavity body as claimed of claim 1, the sticky element is a double sided adhesive tape.

3. A cavity filter, comprising:

a cavity body defining an opening on a top portion thereof and comprising a plurality of bases on a bottom portion thereof;

a plurality of resonators each defining a cavity in communication with the cavity body, and comprising a bottom;

a plurality of screws each securing the bottom of one of the plurality of resonators on one of the plurality of bases of the cavity body, respectively;

a plurality of sticky elements each located between the bottom of one of the plurality of resonators and the head of one of the plurality of screws; and a lid to cover the opening of the cavity body and defining a plurality of screw holes each opposite to the cavity of one of the plurality of resonators, and matched with a tuning screw screwable in the screw holes to adjust a resonating frequency of the cavity filter;

wherein when the resonating frequency of the cavity filter is adjusted, metal shavings produced by the plurality of tuning screws turned in the lid are adhered to the plurality of sticky elements.

4. The cavity filter as claimed in claim 3, wherein the plurality of sticky elements are double sided adhesive tapes.

5. The cavity filter as claimed in claim 3, wherein each screw comprises a head like a figure as substantially a half ellipse shaped.

6. A cavity filter, comprising:

a cavity body defining an opening on a top portion thereof and comprising a plurality of bases on a bottom portion thereof;

a plurality of resonators each defining a cavity in communication with the cavity body, and comprising a bottom;

a plurality of screws each comprising a sharply arc-shaped head to secure the bottom of one of the plurality of resonators on one of the plurality of bases of the cavity body, respectively;

a plurality of sticky elements each located between the bottom of one of the plurality of resonators and the head of one of the plurality of screws; and a lid to cover the opening of the cavity body and defining a plurality of screw holes each opposite to the cavity of one of the plurality of resonators, and matched with a tuning screw screwable in the screw holes to adjust a resonating frequency of the cavity filter;

wherein metal shavings produced by the plurality of tuning screws are adhered to the plurality of sticky elements.

7. The cavity filter as claimed in claim 6, wherein the plurality of sticky elements are double sided adhesive tapes.

* * * * *